United States Patent [19]

Takeuchi

[11] Patent Number: 4,716,990

[45] Date of Patent: Jan. 5, 1988

[54] HYDRAULIC DRIVING CIRCUIT FOR A FORKLIFT TRUCK

[75] Inventor: Toshiyuki Takeuchi, Kariya, Japan

[73] Assignee: Kabushiki Kaisha Toyoda Jidoshokki Seisakusho, Kariya, Japan

[21] Appl. No.: 795,517

[22] Filed: Nov. 6, 1985

[30] Foreign Application Priority Data

Dec. 1, 1984 [JP] Japan ..... 59-183042[U]

[51] Int. Cl.[4] ..... B66B 9/20

[52] U.S. Cl. ..... 187/9 E; 187/17; 91/443

[58] Field of Search ..... 187/9 E, 9 R, 38, 17; 91/443; 60/466; 414/629, 630

[56] References Cited

U.S. PATENT DOCUMENTS

| | | | |
|---|---|---|---|
| 2,349,284 | 5/1944 | Kinzelman | 60/466 |
| 2,868,174 | 1/1959 | Shutt | 91/443 |
| 3,127,956 | 4/1964 | Hosbein et al. | 187/9 E |
| 4,287,812 | 9/1981 | Iizumi | 91/443 |
| 4,318,332 | 3/1982 | Shingu et al. | 91/443 |

*Primary Examiner*—Joseph J. Rolla
*Assistant Examiner*—Kenneth Noland
*Attorney, Agent, or Firm*—Brooks Haidt Haffner & Delahunty

[57] ABSTRACT

An improved hydraulic driving circuit for a forklift truck is disclosed. The flow control valve for controlling the rate of descent of the inner masts and the safety descent valve for preventing sudden descent of the inner masts are provided respectively, on the front or lateral bottom sides of the left and right cylinders which lift or lower the inner masts, in such a manner as to facilitate valve inspection or dismounting.

3 Claims, 5 Drawing Figures

HYDRAULIC DRIVING CIRCUIT FOR A FORKLIFT TRUCK

BACKGROUND OF THE INVENTION

This invention relates to an improved hydraulic driving circuit for a forklift truck in which the rate of descent of the inner masts may be controlled and sudden descent of the inner masts may be prevented from occurring upon breakage of piping sections connecting the left and right side lift cylinders, the forklift truck being of the type in which the inner masts may be lifted or lowered by the operation of the left and right lift cylinders.

The prior-art hydraulic circuit associated with the forklift truck is shown in FIG. 1. Between hydraulic piping sections 10*a*′ and 10*b*′ providing hydraulic communication between the bottom chambers of the left and right side hydraulic lift cylinders 4′ and 5′, there is provided a flow control valve 13′ for controlling the rate of descent of the inner masts (not shown). In a bottom chamber of the left side cylinder 4′ there is mounted a safety descent valve 20′ for preventing the sudden descent of the inner masts (not shown). The valve 20′ is mounted from the bottom end surface of the cylinder 4.

In the above described conventional hydraulic circuit, difficulties are encountered at the time of removing and mounting the flow control valve 13′ and/or the safety descent valve 20′ for inspection or repair. That is, when replacing the flow control valve 13′, the piping sections 10*a*′ and 10*b*′ connecting the valve 13′ and the respective lift cylinders 4′ and 5′ to each other and the piping section 12′ connecting the flow control valve 13′ and an ascent/descent changeover valve 11′ to each other need to be dismounted in advance by a manual operation including a number of separate operating steps. When replacing the safety descent valve 20′, a suitable tool needs to be introduced and manipulated through an operating through-hole 2*a*′ in a lower tie beam 2′ of the outer masts 1′ by a laborious and time-consuming operation. In addition, in a certain conventional mast device for a forklift truck, a mast support 29′ is provided on the lower surface of the lower tie beam 2′ (as shown in FIG. 5). With the mast device, the lift cylinder 4′ needs to be dismounted from the lower tie beam 2′ before proceeding to the dismounting of the safety descent valve 20′.

SUMMARY OF THE INVENTION

It is therefore a principal object of the present invention to eliminate the aforementioned problems of the prior art hydraulic driving circuit and to provide an improved driving hydraulic circuit for a forklift truck with facilitated mounting and dismounting of the flow control valve and the safety descent valve.

The above object and other objects of the present invention are accomplished by providing in a hydraulic driving circuit for a forklift truck, in the left and right lift cylinders of which the bottom chambers are connected to each other by piping means, a flow control valve which is detachably mounted to the outer lateral bottom side of one of the lift cylinders and a safety descent valve which is detachably mounted to the outer lateral bottom side of the other lift cylinder.

BRIEF DESCRIPTION OF THE DRAWINGS

FIGS. 3 to 5 illustrate a preferred embodiment of the hydraulic driving circuit of the present invention, wherein FIG. 3 is a perspective front-side view showing the lower part of the left and right side lifting cylinders; FIG. 4 is a sectional plan view showing the bottom portions of the lifting cylinders; and FIG. 5 is a back-side view of the mast system.

EMBODIMENT OF THE PRESENT INVENTION

Figure 1:
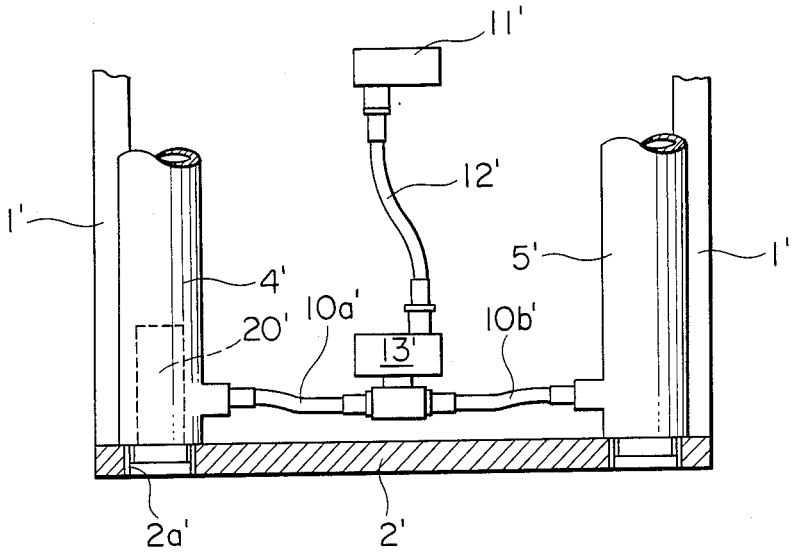
FIG. 1 (PRIOR ART)
FIG. 1 is a back-side view, shown partially in section, of the lower part of the left and right cylinders of a typical prior-art hydraulic driving circuit.
Figure 2:
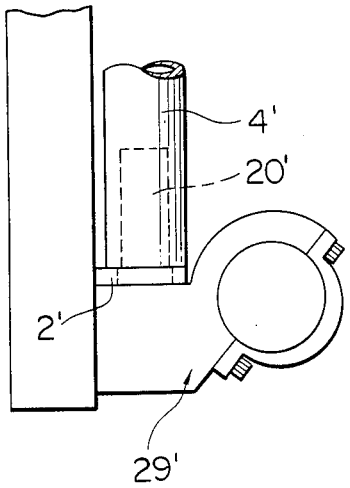
FIG. 2 (PRIOR ART)
FIG. 2 is a diagrammatic side view of a portion of FIG. 1.
Figure 3:
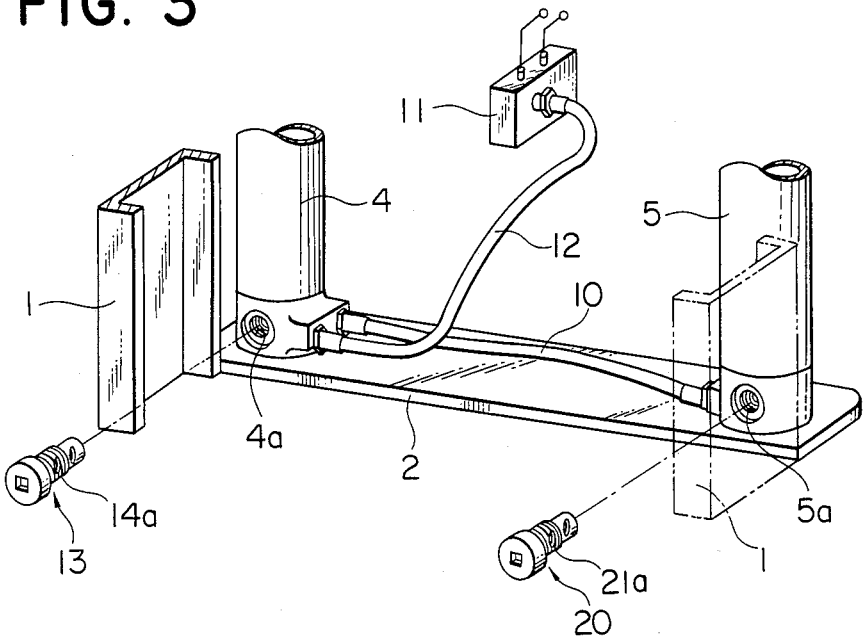
Figure 4:
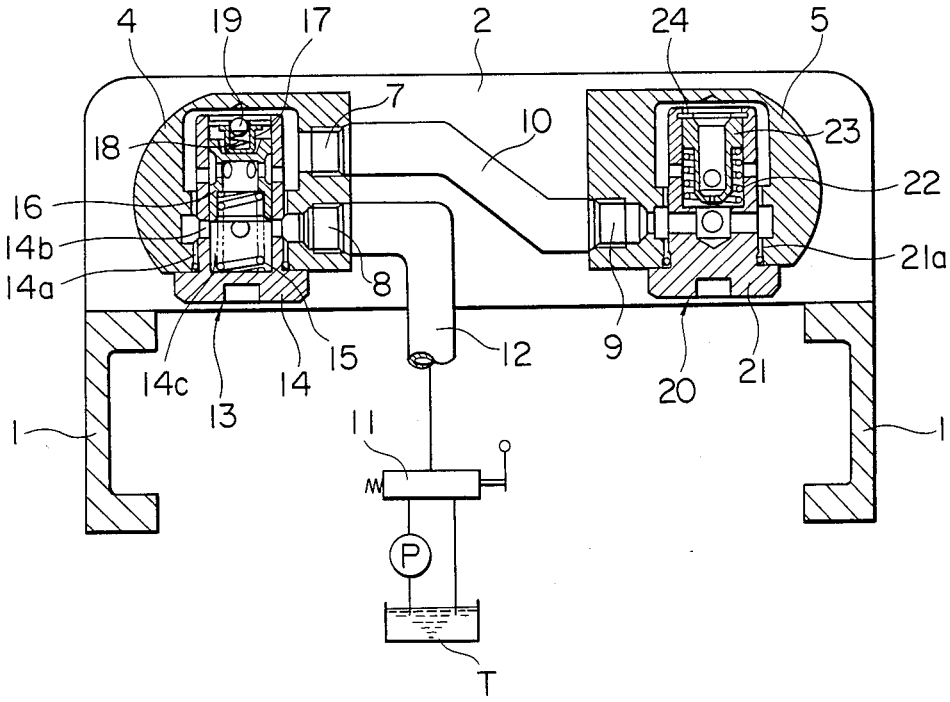
Figure 5:
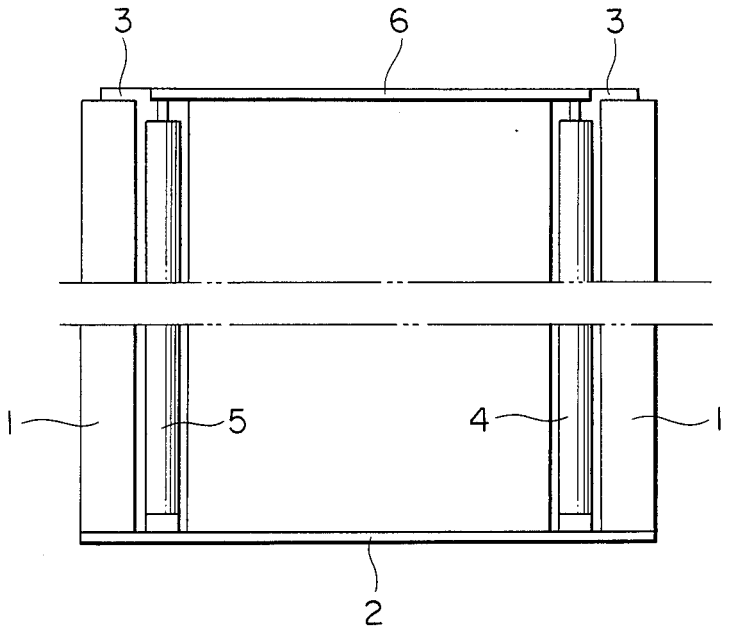

In FIGS. 3 to 5, there is shown a preferred embodiment of the hydraulic driving circuit according to the present invention.

Referring to FIG. 5 which is a back-side view of the mast system for the forklift truck, the left and right outer masts 1 are mounted on the foremost part of the vehicle by the medium of a mast support (not shown) and are connected together by a lower tie beam 2. Left and right side inner masts 3 are associated with these outer masts 1 through the medium of rolls (not shown) so as to be vertically movable with respect to the outer masts 1.

The left and right side lift cylinders 4 and 5 operable to lift or lower the inner masts 3 are mounted upright on the lower tie beam 2 of the outer masts 1. The upper ends of the piston rods associated with the lifting cylinders 4 and 5 are rigidly connected to an upper cross beam 6 connecting the inner masts 3 to each other. In FIGS. 3 and 4, the bottom portion of one of the lift cylinders 4 and 5, i.e. the left side cylinder 4 in the present embodiment, is provided with a first port 7 and a second port 8 so as to be respectively opened into a bottom chamber of the cylinder 4. The bottom portion of the other lift cylinder 5 is provided with a port 9 so as to be opened into a bottom chamber of the cylinder 5. The first port 7 of the lift cylinder 4 and the port 9 of the right cylinder 5 are hydraulically connected to each other by a piping section 10. To the second port 8 of said lift cylinder 4 is connected a piping section 12 connecting to an ascent/descent changeover valve 11. Said changeover valve 11 is connected to a pump P as a hydraulic source and a tank T.

To the bottom chamber of the left side lift cylinder 4, a flow control or adjustment valve 13 for controlling the rate of descent of the inner masts 3 is detachably mounted to some outer peripheral portion, herein the front surface, of the bottom of the left side cylinder 4. In the bottom chamber of the other lift cylinder 5, a safety descent valve 20 designed to prevent abrupt descent of the inner mast 3 in the event of rupture of the piping section 10 is detachably mounted to some outer peripheral portion, herein the front surface, of the right side cylinder 5.

The flow control valve 13 and the safety descent valve 20 may be of any known design and hence the detailed description of these valves is omitted for simplicity. In summary, the flow control valve 13 has a valve body 14 having a central bore 14*c* in which are mounted the valve-operating components comprising a first spring 15, a valve 16, a holder 17, a second spring 18 and a check ball 19 which components removable with the valve. On the outer periphery of the valve body 14, there is a screw-threaded portion 14*a* capable of meshing with a tapped, radially inwardly extending aperture or bore 4*a* formed on the lateral bottom surface of the left side cylinder 4 in communication with the bottom chamber of the cylinder 4. When the changeover valve 11 is switched to descent position, the check ball 19 is moved under the force of the hydraulic oil in the bottom chamber of the lift cylinder 4 against the force of the second spring 18 so that the valve 16 is moved against the bias of the first spring 15. With the valve 16 moved in this manner, the opening area of the oil port 14*b* of the valve body 14 is decreased by a predetermined amount to provide for a safe rate of descent of the inner masts 3.

Further, the safety descent valve 20 has a main valve body 21 in the central bore of which are mounted its valve operating components comprising a spring 22, an orifice valve 23 and a stopper 24 which components are removable with the valve. To the outer periphery of the neck of the valve body 21 is formed a screw-threaded portion 21*a* meshing with a tapped, radially inwardly extending aperture or bore 5*a* formed in the lateral bottom surface of the cylinder 5 in communication with the bottom chamber of the cylinder 5. In the event of the rupture of the piping section 10 providing communication between the bottom chambers of the lift cylinders 4 and 5, the orifice valve 23 is shifted against the bias of the spring 22 under the pressure of the hydraulic oil in the bottom chamber of the right lift cylinder 5 so as to inhibit sudden descent of the piston rod of the lift cylinder 5 and hence of the inner masts 3.

In the above described embodiment, the flow control valve 13 and the safety descent valve 20, including their operating components, can be dismounted for exchange or inspection by unscrewing from the radially inward bores 40*a* and 5*a* in the front sides of the bottom portions of the lift cylinders 4 and 5, respectively. The valves 13 and 20 can also be mounted by screwing into the bores 4*a* and 5*a*.

According to the present invention, the flow control valve 13 and the safety descent valve 20 are designed to be mounted to and dismounted from the front bottom sides of the lift cylinders 4 and 5. However, the valves 13 and 20 can also be designed to be mounted to or dismounted from the back or lateral bottom sides of the cylinders 4 and 5 without departing from the scope of the present invention.

It is thus seen that the present invention provides an arrangement in which the flow control valve and the safety descent valve can be mounted or dismounted from the transverse sides of the bottom portions of the left and right lift cylinders for facilitating valve mounting or dismounting and hence the operating efficiency of the forklift truck.

What I claim is:

1. An hydraulic driving circuit on a forklift truck, comprising:

a substantially horizontal tie beam on said truck;

respectively parallel and substantially vertical first and second hydraulic lift cylinders, having respective bottom ends, mounting on said tie beam;

a substantially vertical inner mast mounted for vertical movement on said truck, and means connecting said inner mast to said first and second hydraulic lift cylinders for said vertical movement of the inner mast responsive to hydraulic actuation of said cylinders;

means defining respective bottom chambers within each of said hydraulic lift cylinders adjacent to their said respective bottom ends;

an hydraulic fluid piping connection between said respective bottom chambers of said hydraulic lift cylinders;

hydraulic fluid pump means on said truck, including a changeover valve means switchable between a cylinder-ascent position and a cylinder-descent position, and an hydraulic fluid piping connection between said pump means and said bottom chamber of said first hydraulic lift cylinder;

means defining respective valve-receiving apertures in each of said first and second hydraulic lift cylinders, each said valve-receiving aperture extending radially inwardly into said bottom chamber of its said associated lift cylinder from the exterior thereof;

a fluid flow control valve removably mounted in said valve-receiving aperture of said first hydraulic lift cylinder; and a safety descent valve removably mounted in said valve-receiving aperture of said second hydraulic lift cylinder, whereby said flow control valve and said safety descent valve are each removable from an accessible location on the periphery of said hydraulic lift cylinder on which it is mounted.

2. An hydraulic driving circuit on a forklift truck according to claim 1, wherein said forklift truck has a front side, and said accessible locations face said front side, whereby each of said flow control and safety-descent valves is removable from said front side of said truck.

3. An hydraulic driving circuit on a forklift truck according to claim 1, wherein each of said flow control and safety-descent valves comprises valve-operating components connected thereto, so as to be removable therewith.

* * * * *